US008297392B2

(12) United States Patent
Treichel et al.

(10) Patent No.: US 8,297,392 B2
(45) Date of Patent: Oct. 30, 2012

(54) HYBRID ENERGY MANAGEMENT SYSTEM

(75) Inventors: Benjamin A. Treichel, Peoria, IL (US); David L. Collins, Peoria, IL (US); Stephen Eric Post, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 215 days.

(21) Appl. No.: 12/889,643

(22) Filed: Sep. 24, 2010

(65) Prior Publication Data

US 2011/0073392 A1 Mar. 31, 2011

Related U.S. Application Data

(60) Provisional application No. 61/245,848, filed on Sep. 25, 2009.

(51) Int. Cl.
*B60K 1/00* (2006.01)

(52) U.S. Cl. ..... 180/65.31; 180/65.51

(58) Field of Classification Search ..... 180/65.31, 180/65.1, 65.51, 65.8, 216; 318/143, 466, 318/125, 370
See application file for complete search history.

(56) References Cited

U.S. PATENT DOCUMENTS

| | | | | |
|---|---|---|---|---|
| 1,901,685 | A * | 3/1933 | Whiting | 318/143 |
| 3,657,625 | A * | 4/1972 | Miller et al. | 318/370 |
| 5,019,759 | A * | 5/1991 | Takemura et al. | 318/466 |
| 5,789,882 | A | 8/1998 | Ibaraki et al. | |
| 6,344,732 | B2 | 2/2002 | Suzuki | |
| 6,507,127 | B1 | 1/2003 | Amano et al. | |
| 6,615,118 | B2 | 9/2003 | Kumar | |
| 6,708,787 | B2 | 3/2004 | Naruse et al. | |
| 6,909,200 | B2 | 6/2005 | Bouchon | |
| 6,959,241 | B2 | 10/2005 | Itow et al. | |
| 7,069,673 | B2 | 7/2006 | Kagoshima et al. | |
| 7,260,510 | B2 * | 8/2007 | Sumida | 703/2 |
| 7,308,958 | B2 | 12/2007 | Tamor et al. | |
| 7,926,608 | B2 * | 4/2011 | Horii et al. | 180/216 |
| 7,942,225 | B2 * | 5/2011 | Carabelli et al. | 180/65.31 |
| 8,056,658 | B2 * | 11/2011 | Horii et al. | 180/65.1 |
| 8,166,810 | B2 * | 5/2012 | Chen et al. | 73/146.4 |
| 2008/0183348 | A1 | 7/2008 | Arita et al. | |
| 2009/0127011 | A1 | 5/2009 | Zhang | |
| 2009/0217653 | A1 * | 9/2009 | Zhang et al. | 60/414 |

FOREIGN PATENT DOCUMENTS

| | | |
|---|---|---|
| DE | 1002006001201 | 7/2007 |
| JP | 2002359935 | 12/2002 |
| WO | 2008140359 | 11/2008 |

* cited by examiner

*Primary Examiner* — Hau Phan
(74) *Attorney, Agent, or Firm* — Dave E. Roberts

(57) ABSTRACT

A hybrid energy management system that estimates the net regenerative energy that can be collected during the breaking action of the swing mechanism, then, since this is the net energy that can be used to recharge an energy storage device without using the engine to help recharge the energy storage device, the system limits the use of the energy storage device to that net amount predicted to be available from the recovery period. The net regenerative energy is calculated by considering motor and inverter efficiencies for transferring energy to the battery and changes in the boom/stick/bucket inertia moment.

14 Claims, 19 Drawing Sheets

HYBRID ENERGY MANAGEMENT SYSTEM

RELATED APPLICATIONS

This application is based upon and claims the benefit of priority from U.S. Provisional Application No. 61/245,848 by David L. Collins et al., filed Sep. 25, 2009, the contents of which are expressly incorporated herein by reference.

TECHNICAL FIELD

The present disclosure relates generally to a hybrid energy management system. More particularly, the present disclosure relates to a hybrid energy management system wherein the management system regulates the amount of overall energy available from an energy storage system during a discharge cycle to increase fuel efficiency and prolong energy storage system life.

BACKGROUND

As hybrid powertrains that include an energy storage device as part of an energy storage system (ESS), gain favor over conventional powertrains or hybrid powertrains that do not include such a device, energy management systems are being developed that will maximize overall fuel efficiency and prolong the life of said energy storage devices. Such devices may include batteries, supercapacitors, or other suitable devices, with the battery being the main device referred to herein. Of particular importance presently is a management system that defines the functional requirements for a hybrid electric swing drive system with ESS to be used on a hydraulic excavator (HEX). Energy management systems incorporating ESS are particularly attractive in HEX settings because of the predictable, repeated operation cycles. That is, the HEX operates the majority of the time in a known repeated cycle having (1) a motoring period where a swing motor or other energy supply component initiates rotational movement of the HEX's bucket, stick/boom, optional load, cab, etc. and (2) a breaking period where force is exerted to slow and stop said rotational movement. When an ESS is incorporated, energy can be stored during the breaking period for use during, e.g., the motoring period. Moreover, the swing mechanism has high inertial forces that do not exist in most other work machines, making it a favorable setting in which to utilize ESS.

One approach of managing hybrid energy systems is disclosed in by Bouchon (U.S. Pat. No. 6,909,200). Bouchon discloses an energy management system where energy recovered from regenerative breaking is preferred over energy supplied by the energy generating device. However, Bouchon is silent regarding energy management of energy generated during a swing cycle of a hybrid HEX and, more importantly, is silent regarding limiting the energy taken from the battery.

SUMMARY OF THE INVENTION

In one embodiment, the present disclosure is directed to a machine having a body, a chassis, and an engine. The machine further comprises a swing mechanism that rotates the body relative to the chassis about an axis; an electric motor/generator in electrical communication with the swing mechanism; an energy storage device in electrical communication with the swing mechanism; and an energy management system configured to determine a transition from a discharge period to a recovery period. Moreover, the energy management system responsively estimates the net energy generated by the swing mechanism during the recovery period; limits the energy available for use from the energy storage device during the discharge period to the estimated net energy generated from the swing mechanism; and recharges the battery from the actual net energy generated during the recovery period.

BRIEF DESCRIPTION OF THE DRAWINGS

Whenever possible, the same reference numbers will be used throughout the drawings to refer to the same or like parts.

DETAILED DESCRIPTION

Figure 1:
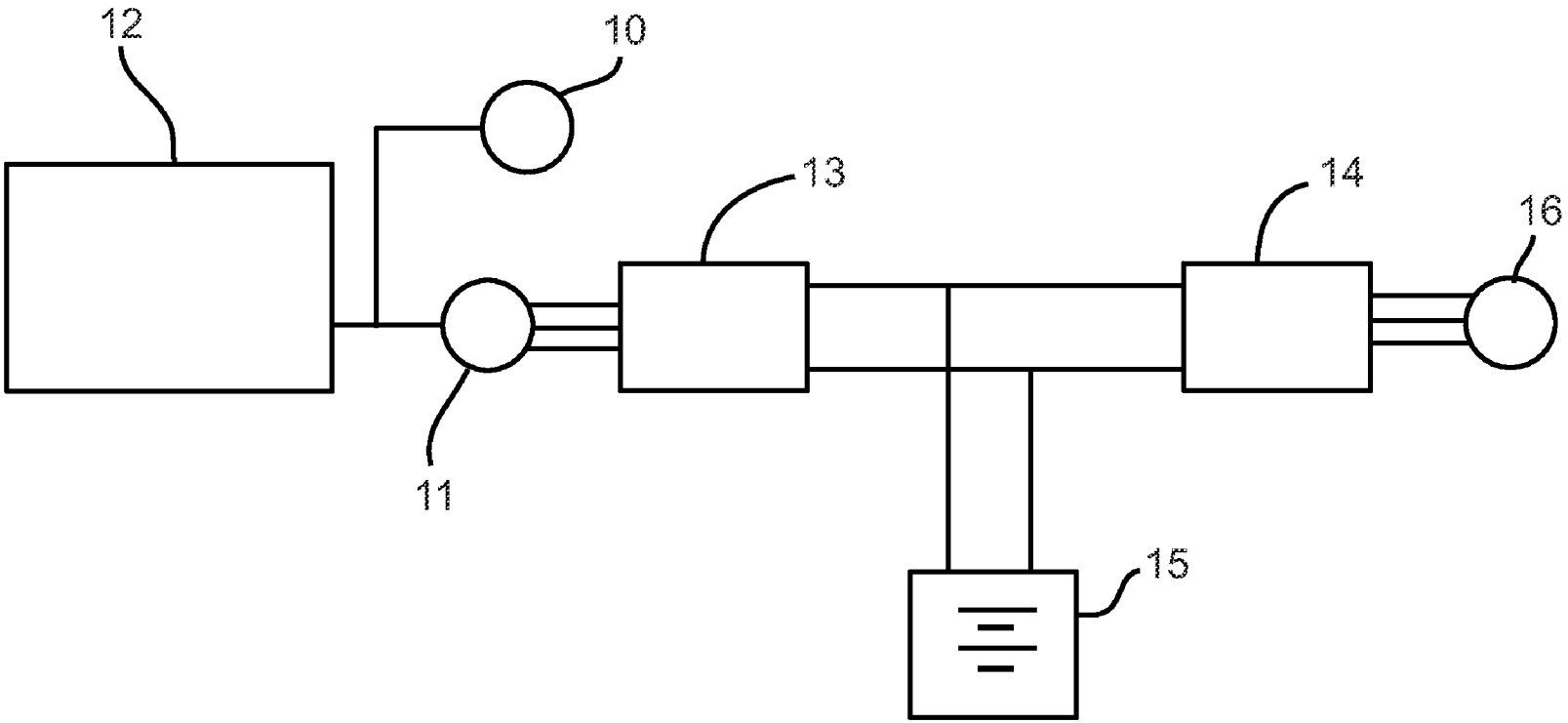
FIG. 1 is a schematic drawing of the powertrain and associated components of a machine employing the hybrid management system of this disclosure.

A hybrid energy management system has been designed such that it may recover and store energy from swing inertia during what is referred to herein as a recovery period. Further, as shown in FIG. 1, ESS 15 will provide electrical energy to drive an electric swing motor 16 during what is referred to herein as a discharge period, as well as for transient torque assist. To do so, the hybrid energy management system estimates the net regenerative energy that can be collected during the breaking action of the swing mechanism i.e., the recovery period. Since that equates to the net energy that can be used to recharge ESS 15 without using the engine 12, the hybrid energy management system regulates the amount of energy supplied by a motor/generator 11 such that the energy drawn from ESS 15 is limited to that net amount predicted to be available from the recovery period. The net regenerative energy is calculated by considering systemic inefficiencies, such as from motor 16 and inverters 13 and 14, for transferring energy to ESS 15 and changes in the boom/stick/bucket inertia moment.

This hybrid energy management system also facilitates the application of new machine energy management strategies and controls to reduce the energy requirements of the engine 12, such as a diesel engine, which improves efficiency and fuel consumption. More particularly, a motor/generator 11, such as a crankshaft-mounted generator, operates in both a generating mode to supply energy to a swing motor 16, and motoring mode to provide engine transient assist, typically from about 1 to about 2 seconds in duration.

The input of the motor/generator 11 is connected to engine 12 and the output may be connected to one or more power inverters 13 and 14, such as a three-phase power inverter using IGBT technology. The power inverters 13 and 14 convert the AC power from the generator 11 onto a DC bus. During motoring mode, inverters 13 and 14 receive the DC power from the bus and convert it back to AC power while the motor/generator 11 provides mechanical energy back onto the common mechanical drive, which may be shared with, e.g., the engine 12 and one or more hydraulic pumps 10.

One possible operation of the motor/generator 11 is to function as a load assist in electrical draw from ESS 15 when discharging, i.e., providing propulsive energy to the swing gear and providing electrical energy to maintain ESS 15 at a designated State of Charge (SOC). Doing so ensures that the swing gear system is able to sustain the desired charge. Such a configuration should allow the motor/generator 11 to provide from about 1 to about 2 seconds of transient torque assist to engine 12, allowing for either reduced engine speed operation or even reduced engine size, i.e., a lower maximum power engine.

The swing motor 16 operates in both a motoring mode to supply mechanical energy to a swing drive and generating mode to provide regenerative braking of the swing drive. The input of swing motor 16 is connected to a 3-phase power inverter 13 using IGBT technology. The output of the swing motor 16 is connected to the swing drive, which reduces motor speed and provides propulsive effort to swing the machine structure. During motoring mode, power inverter 14 converts the DC power from the DC bus into controlled AC power delivered to the swing motor 16. During braking mode, the power inverter 14 receives the AC power generated by the swing motor 16 and converts it into a regulated DC output.

With reference to the figures, FIG. 1 shows the hybrid energy management system architecture and layout. One possible configuration includes a DC Bus from about nominal 600 VDC to about 700 VDC and electric machines from about 450 VAC-3 Phase to about 500 VAC-3 Phase. ESS 15 may further include a Bidirectional Voltage Converter (BDC) that allows for the use of 325 VDC ESS's.

Figure 2:
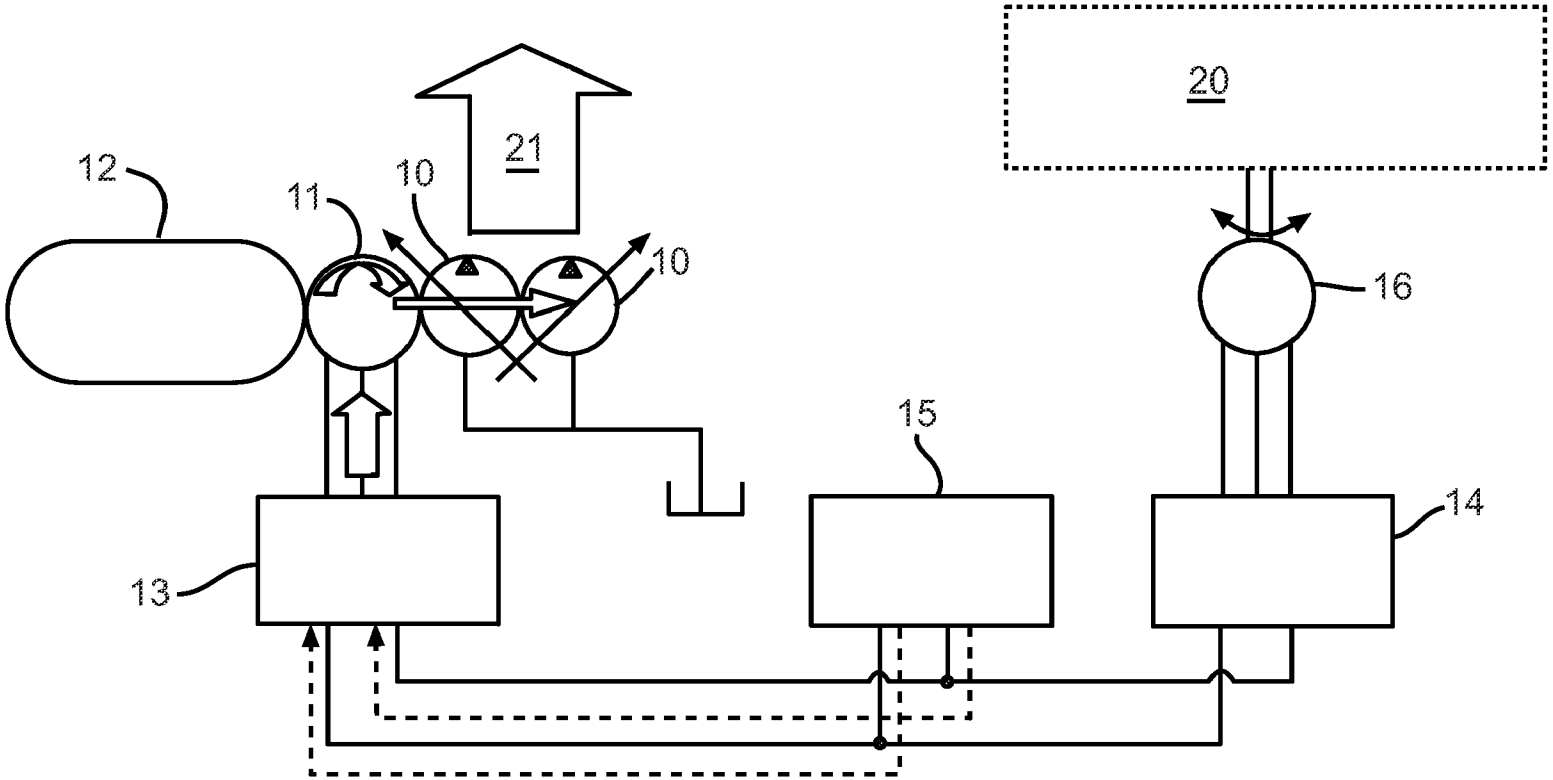
FIG. 2 is a schematic drawing of a first mode of using the hybrid management system of this disclosure.
Figure 3:
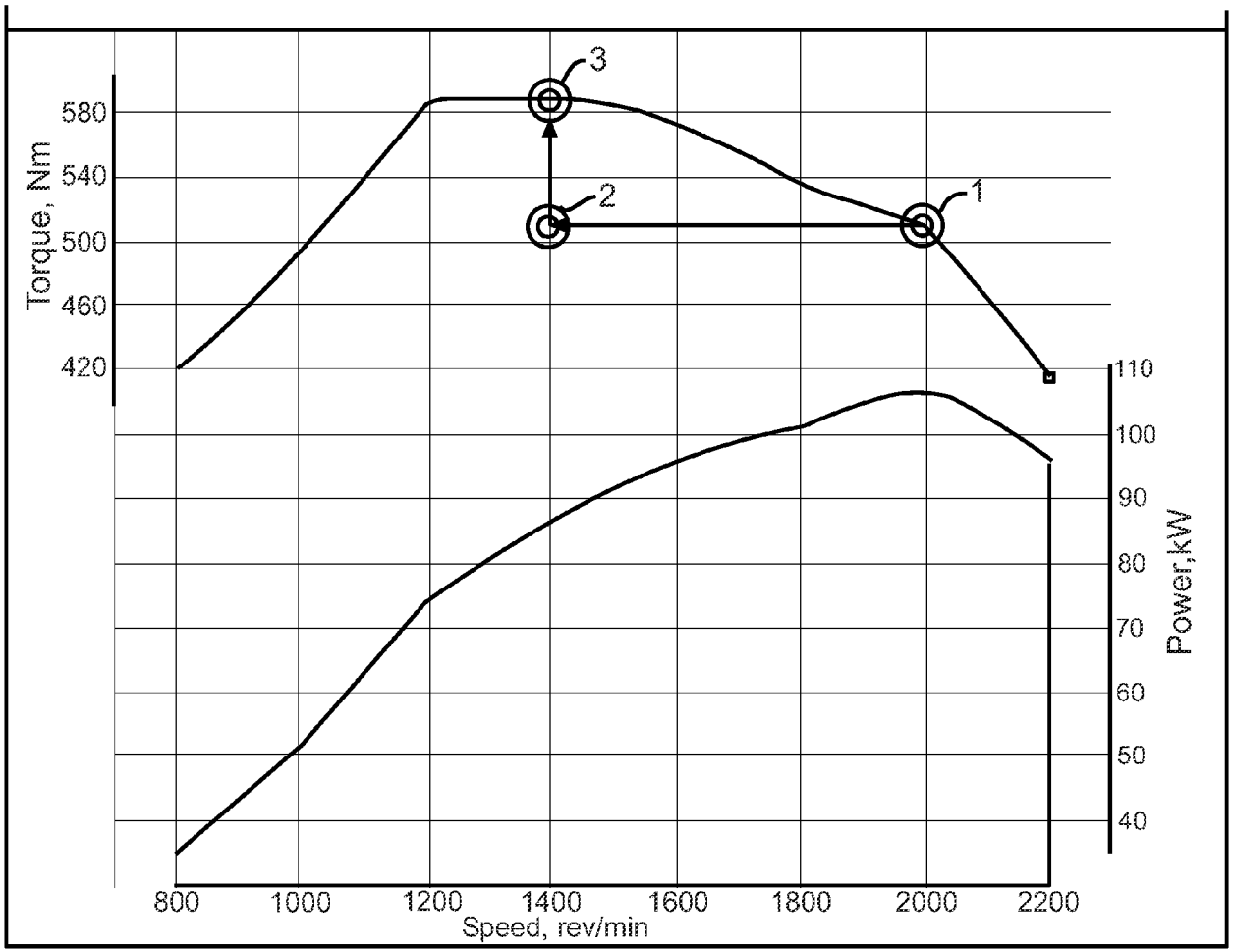
FIG. 3 is a combined chart showing the torque and power generated by an engine at varying engine speeds.

There are several available modes of energy transfer in the electric swing drive hybrid energy management system. FIGS. 2 and 4-9 detail seven such modes. As illustrated therein, swing motor 16 operates the swing drive 20 while hydraulic pump 10 operates hydraulic functions 21. FIG. 2 shows a detail of a Transient Torque Assist for the case of lowering engine speed versus downsizing engine 12. FIG. 3 details this mode by showing the torque versus speed and power versus speed for a typical cycle in the first mode. One example of a typical engine operation is to set engine 12 to the point shown as #1. When load occurs, engine 12 may droop to a performance, such as the one designated as point #3. In such an example, the difference in Point #2 to Point #3 shows the torque rise that occurs due to the engine droop. For reference, Point #2 shows the same engine torque as point #1, but at a lower speed. At a point such as Point #2, there is no torque rise available when the engine droops, which causes the machine response to suffer. If a generator is used at Point #2 performing a "Transient Torque Assist" function, the engine can operate at a lower, more fuel efficient speed and maintain machine response. This is accomplished by adding the torque rise from the generator.

Regarding issues of system energy recovery, it is assumed for analytical purposes that the swing system will be able to recover at least about 40%, such as at least about 50%, or at least about 60% of the swing energy, that the motor/generator 11 is at least about 90% efficient, such as at least about 95% efficient, that ESS 15 is at least about 85% efficient, such as at least about 93% efficient, and that the swing motor 16 is at least about 85% efficient, such as at least about 93% efficient.

ESS 15 will be used to store energy from recovered swing energy from swing motor 16 and energy provided by motor/generator 11.

The following control strategies have been devised to ensure that swing system components achieve their life and efficiency targets, as well as to facilitate the application of new engine management strategies.

Figure 4:
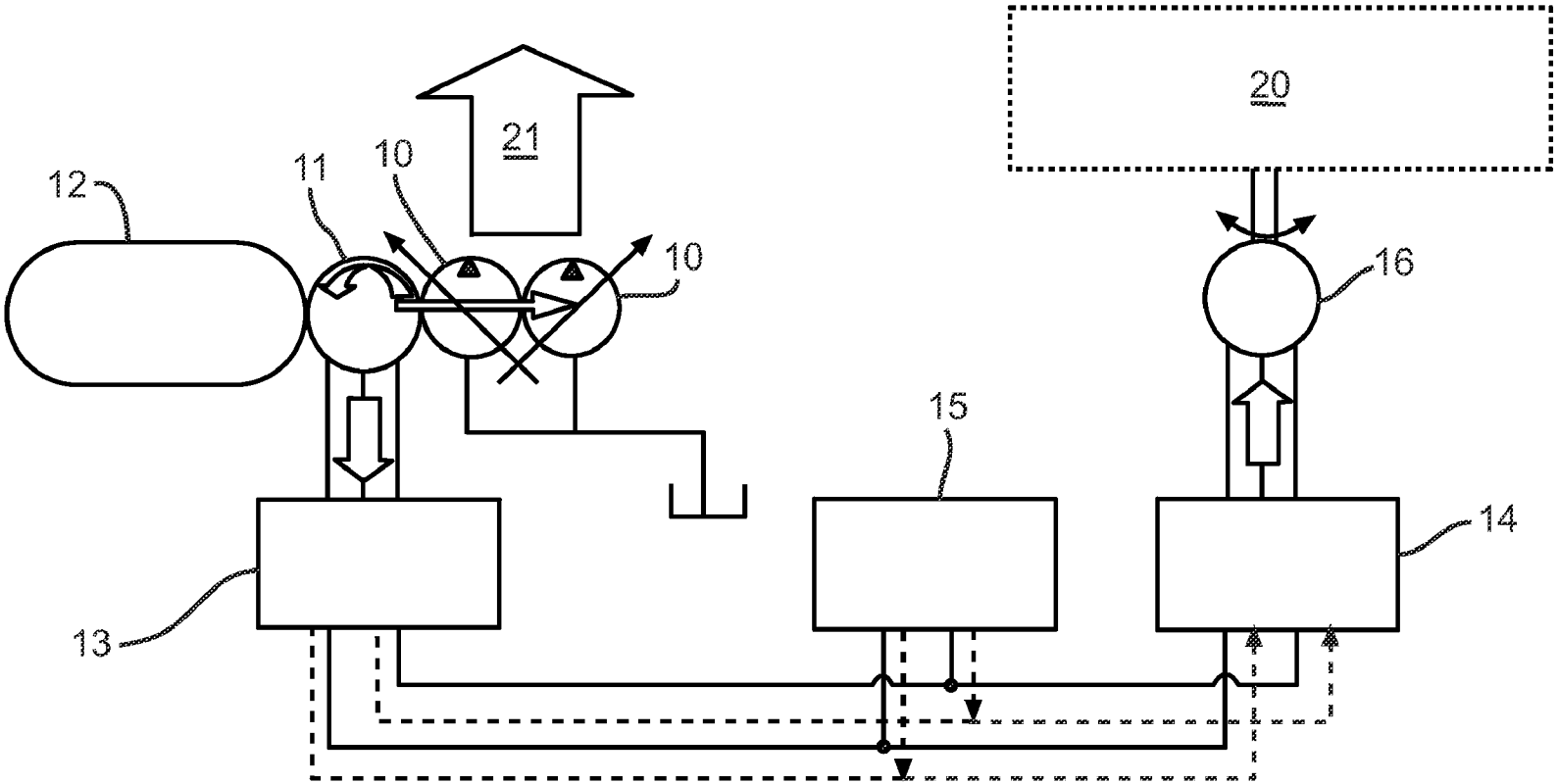
FIG. 4 is a schematic drawing of a second mode of using the hybrid management system of this disclosure.
Figure 5:
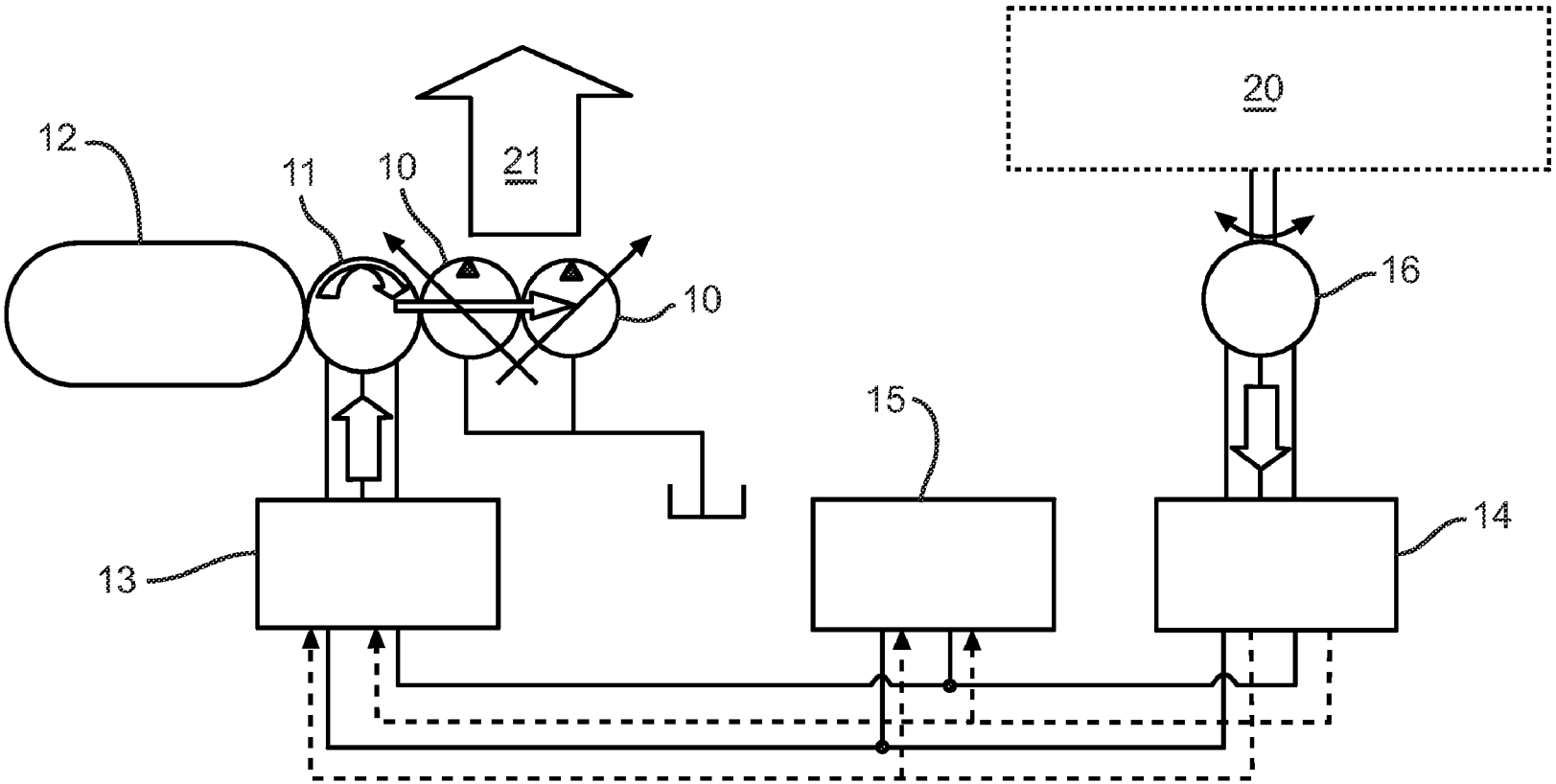
FIG. 5 is a schematic drawing of a third mode of using the hybrid management system of this disclosure.
Figure 6:
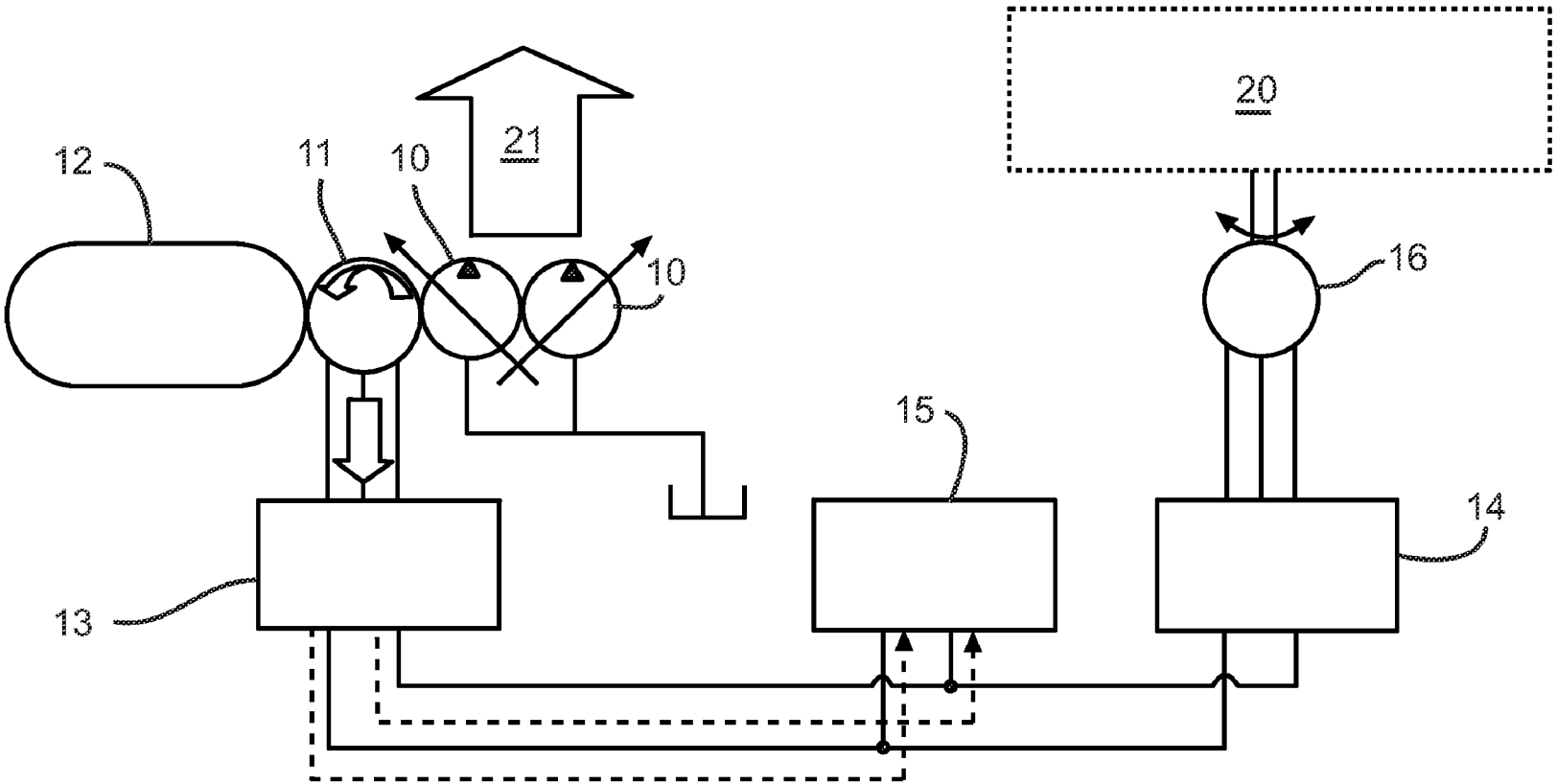
FIG. 6 is a schematic drawing of a fourth mode of using the hybrid management system of this disclosure.
Figure 7:
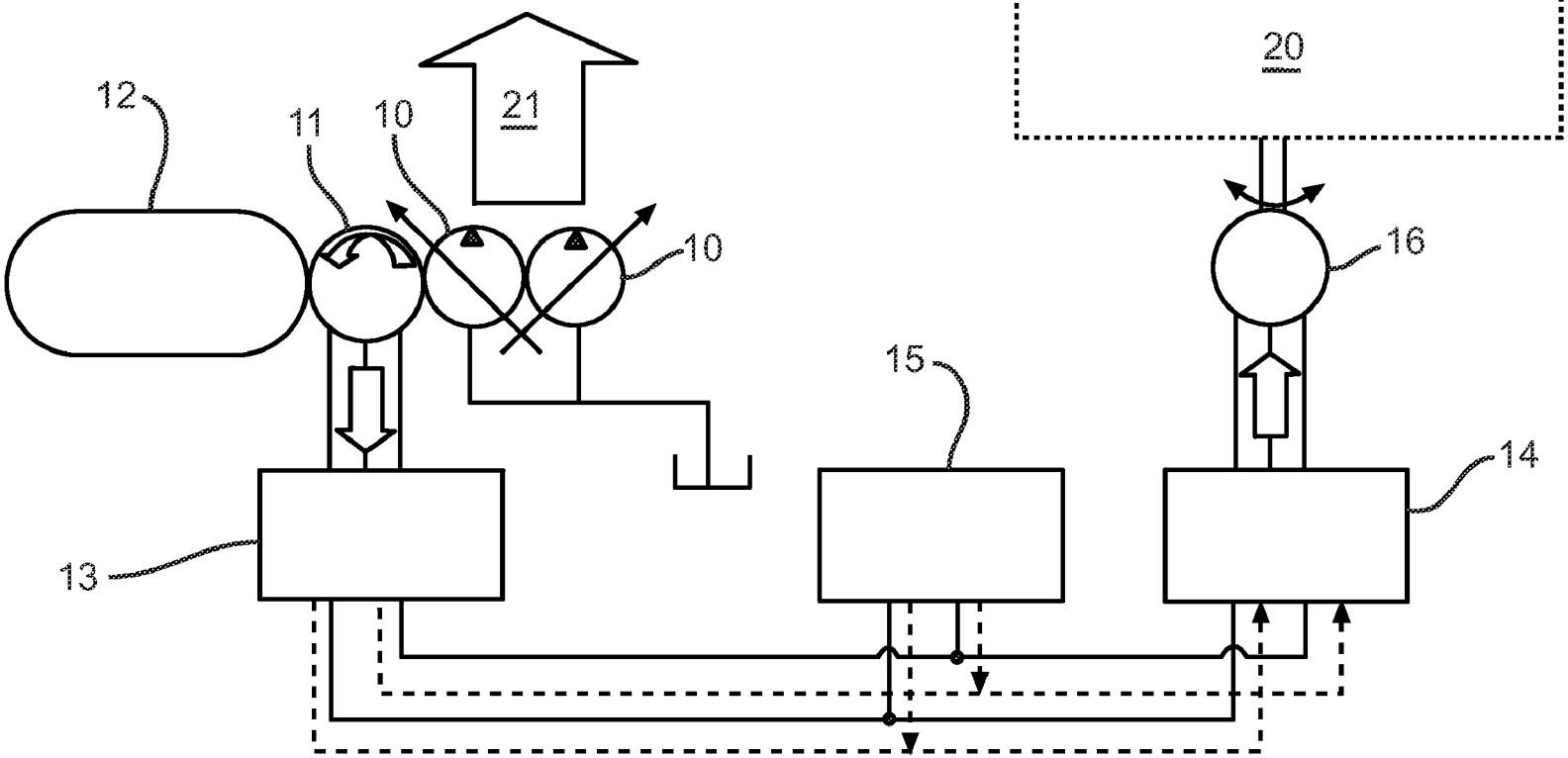
FIG. 7 is a schematic drawing of a fifth mode of using the hybrid management system of this disclosure.
Figure 8:
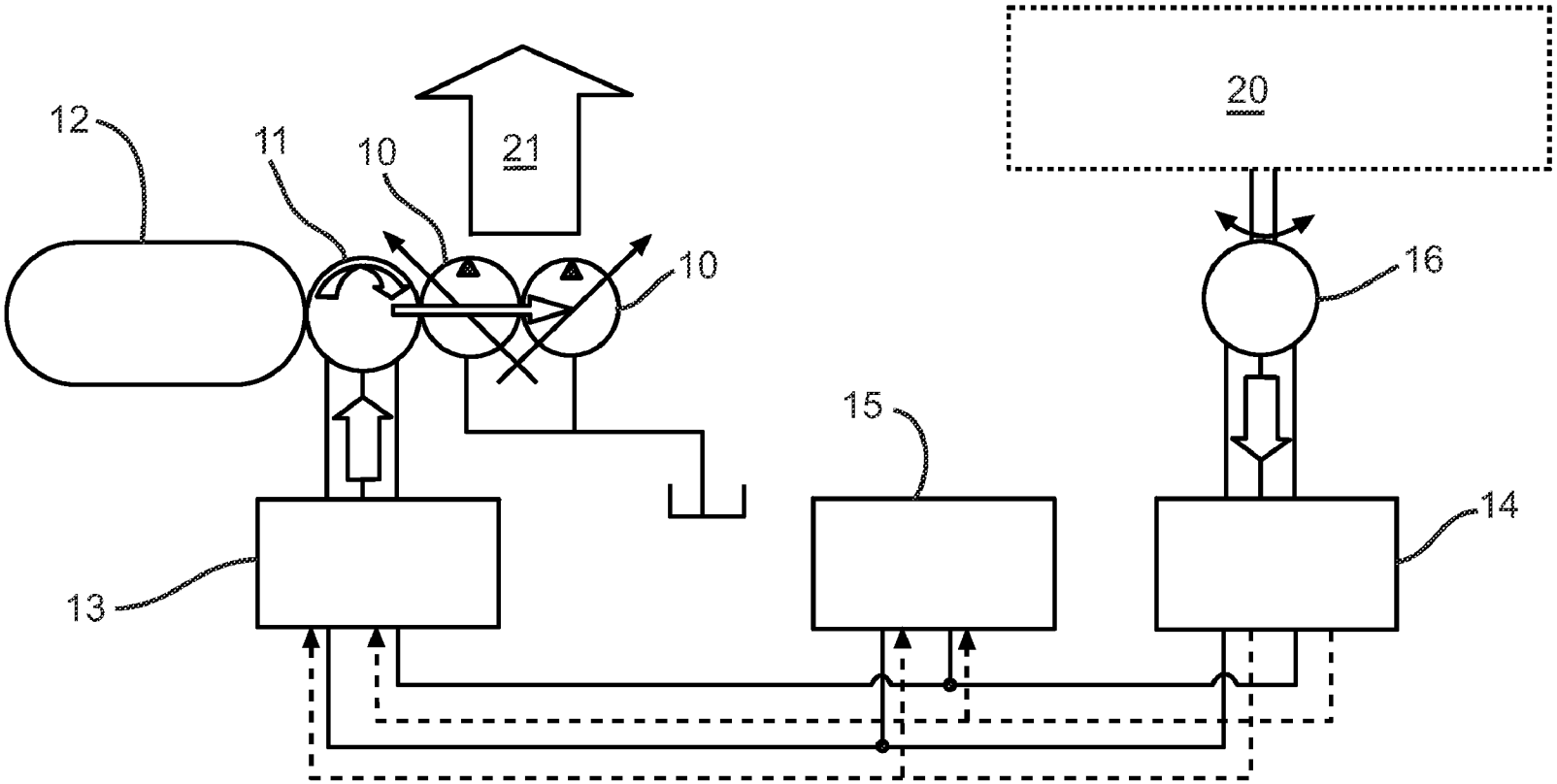
FIG. 8 is a schematic drawing of a sixth mode of using the hybrid management system of this disclosure.
Figure 9:
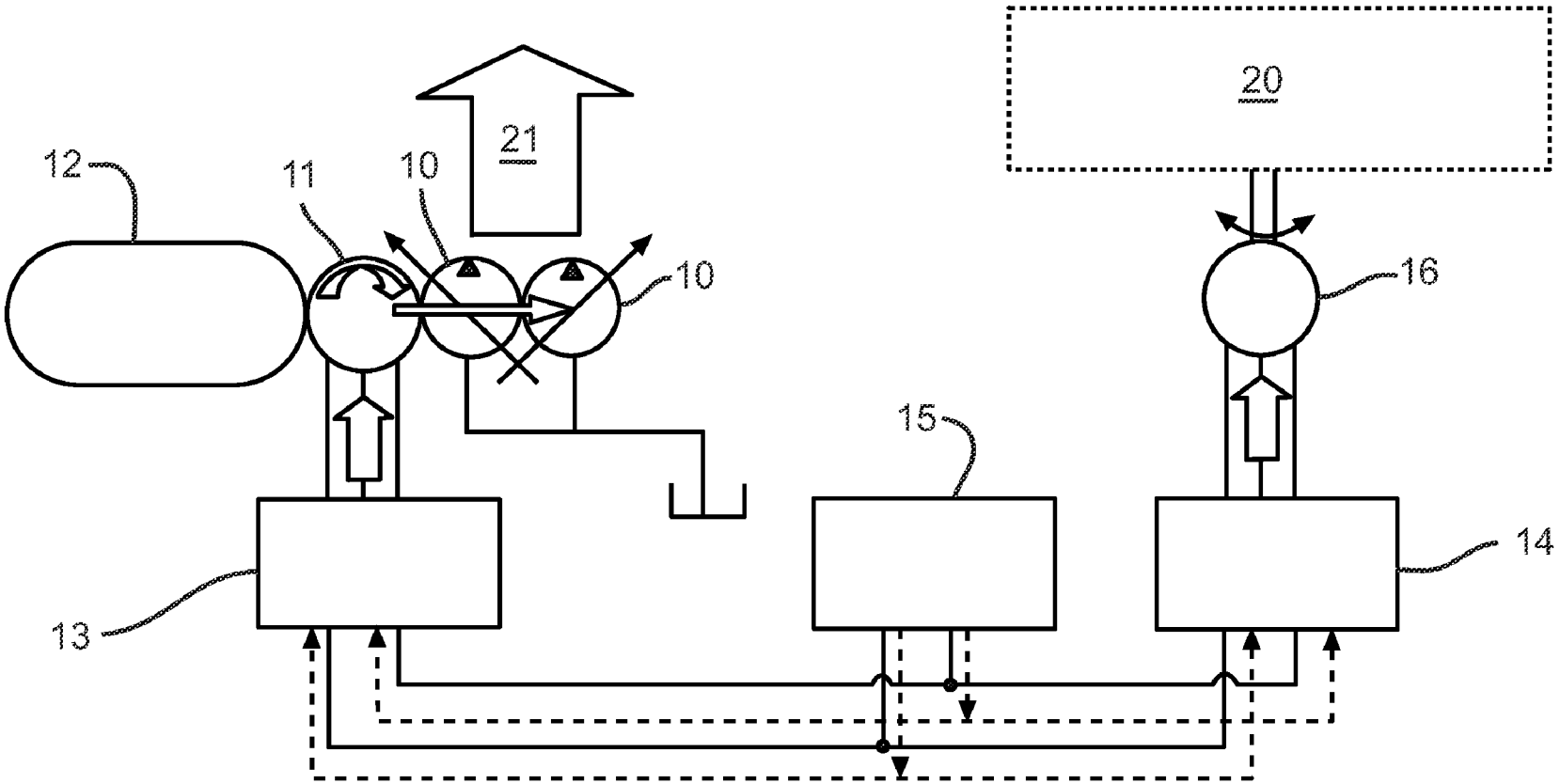
FIG. 9 is a schematic drawing of a seventh mode of using the hybrid management system of this disclosure.

Shown in FIGS. 4 and 5 are "mode 2" and "mode 3," respectively, which are drawings that illustrate the key concepts of "energy split" and "transient torque assist." The key concept behind the energy split setting is to minimize the amount of energy that cycles through ESS 15. According to system analysis, as much as about 40% of the energy used by the swing system is lost to various system inefficiencies. Therefore, it would only increase system losses to cycle this energy through ESS 15. Some examples of these are friction loss in the swing drive and motor and inverter conversion inefficiencies.

The energy split strategy attempts to predict these losses, and uses motor/generator 11 and/or swing motor 16 to make up for these losses. Therefore, only the amount of energy that is expected to be "regenerated" and supplied back to ESS 15 is made available to be drawn out from ESS 15. This strategy reduces system losses by avoiding the cycling of energy through ESS 15 that is destined to be lost. In addition, this strategy reduces the depth of the ESS cycles, thus reducing wear and extending life of ESS 15.

The strategies to support the implementation of the transient torque assist control scheme—as explained in the mode 1 discussion—are important to allow the application of new machine energy management strategies and controls to reduce the energy requirements of the diesel engine for improved efficiency and fuel consumption. Additionally, the hybrid energy management system facilitates further efficiency by supporting transient torque assist strategies.

One control management strategy defines the idea of torque (or energy) sources or torque (or energy) sinks for repetitive action work machines. Using this concept, the control system manages engine energy available (torque source) to the various system components (torque sinks). This concept is built upon managing multiple torque sources, such as the swing system, ESS 15, or the hydraulic accumulators 10 for boom down. Therefore the interface to the control system defines the swing system components as either torque sources or sinks.

Internal to the swing system, the torque command is generally expressed as either power or energy. For mechanical work, the base units are N·m and radians per second. For electrical work, the base units are DC Volts or DC Amps. Power is either expressed as kilowatts (kW) or kilojoules (kJ). The interface to the inverter controls is via kW.

The hybrid energy control system communicates to the swing system by directing a percentage of full torque that is required at the swing motor. In addition, to accommodate transient torque assist, the hybrid energy control system also commands the required assist torque in terms of zero to full torque available. It should be noted that the hybrid energy management system does not recognize that a device can be both a sink and a source. Therefore, the hybrid energy management system takes these two commands and combines them as a single command within the swing system. Within the swing system, positive torques motor a device, while negative torques are the regenerative events.

Figure 10:
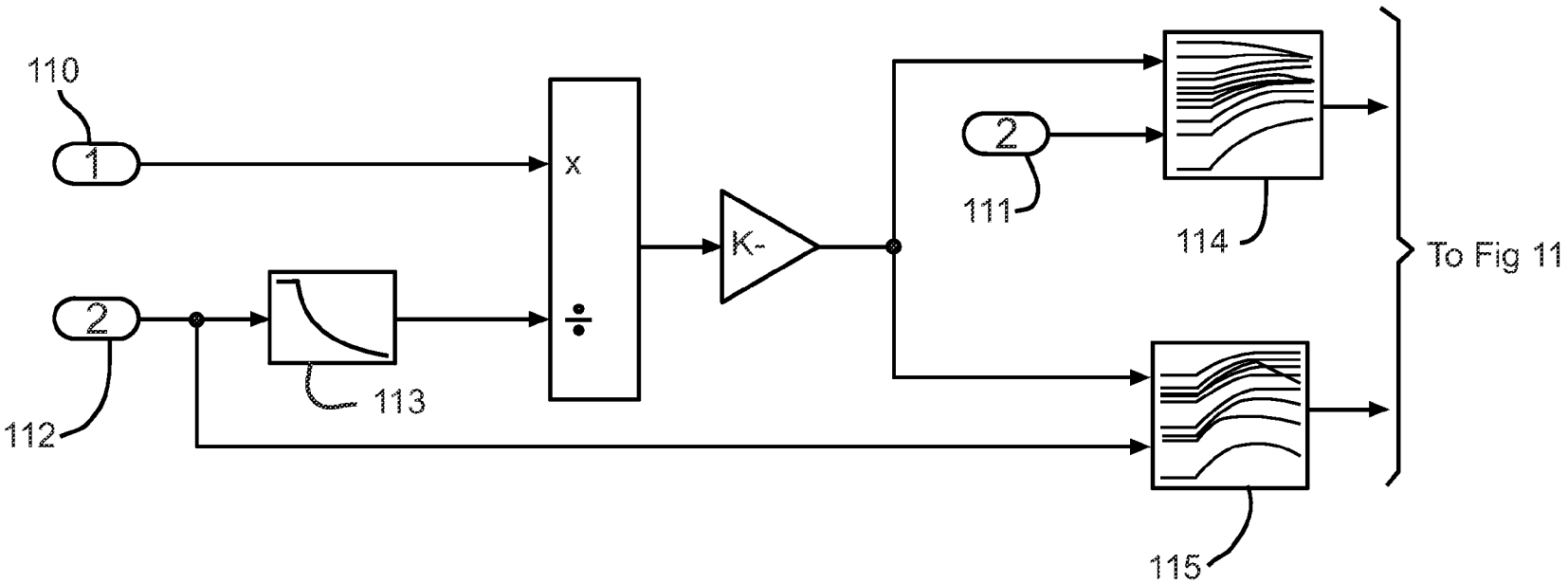
FIGS. 10-12 combine to form an overall schematic illustrating the operation of the hybrid management system of this disclosure.
Figure 11:
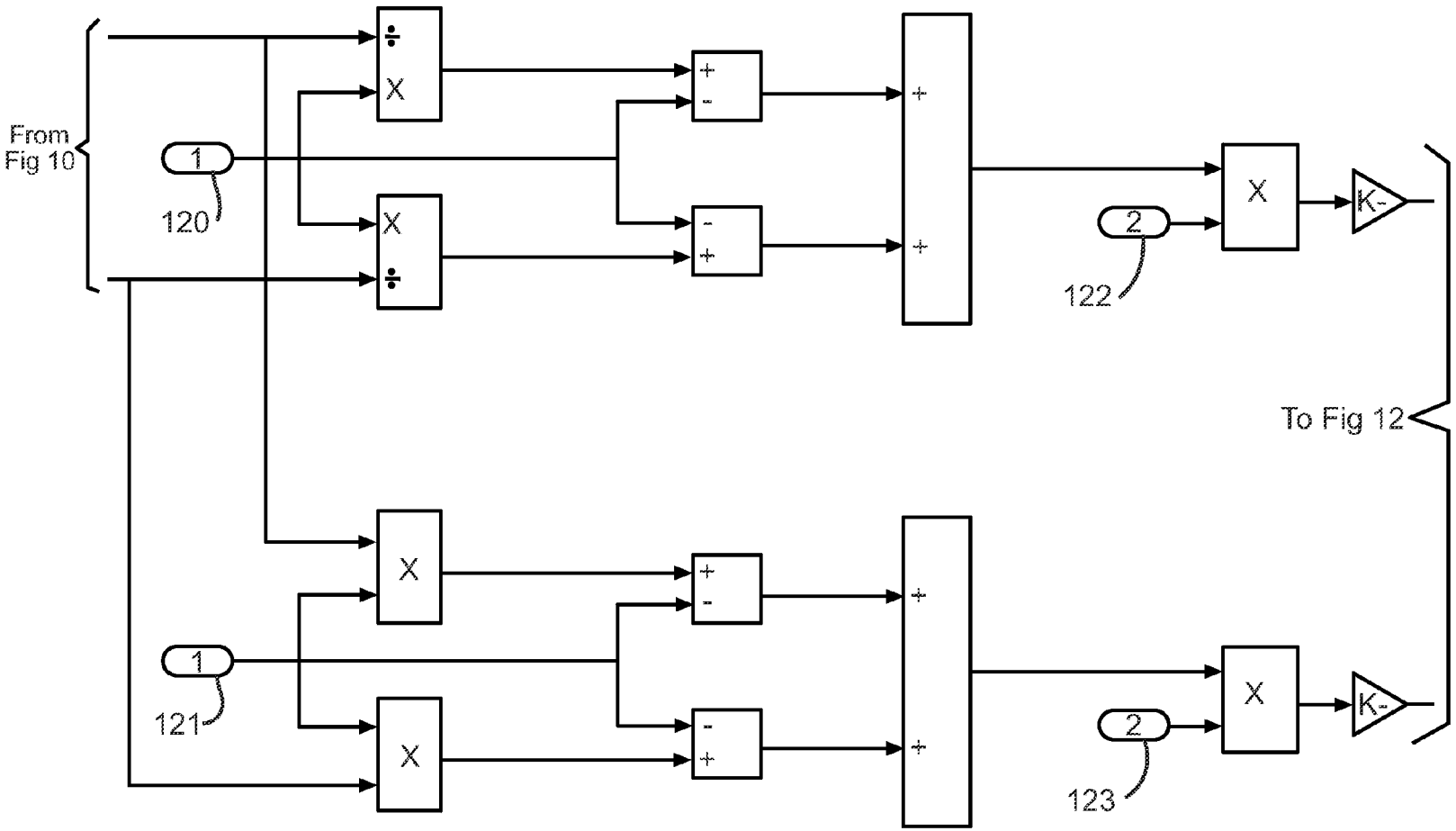
Figure 12:
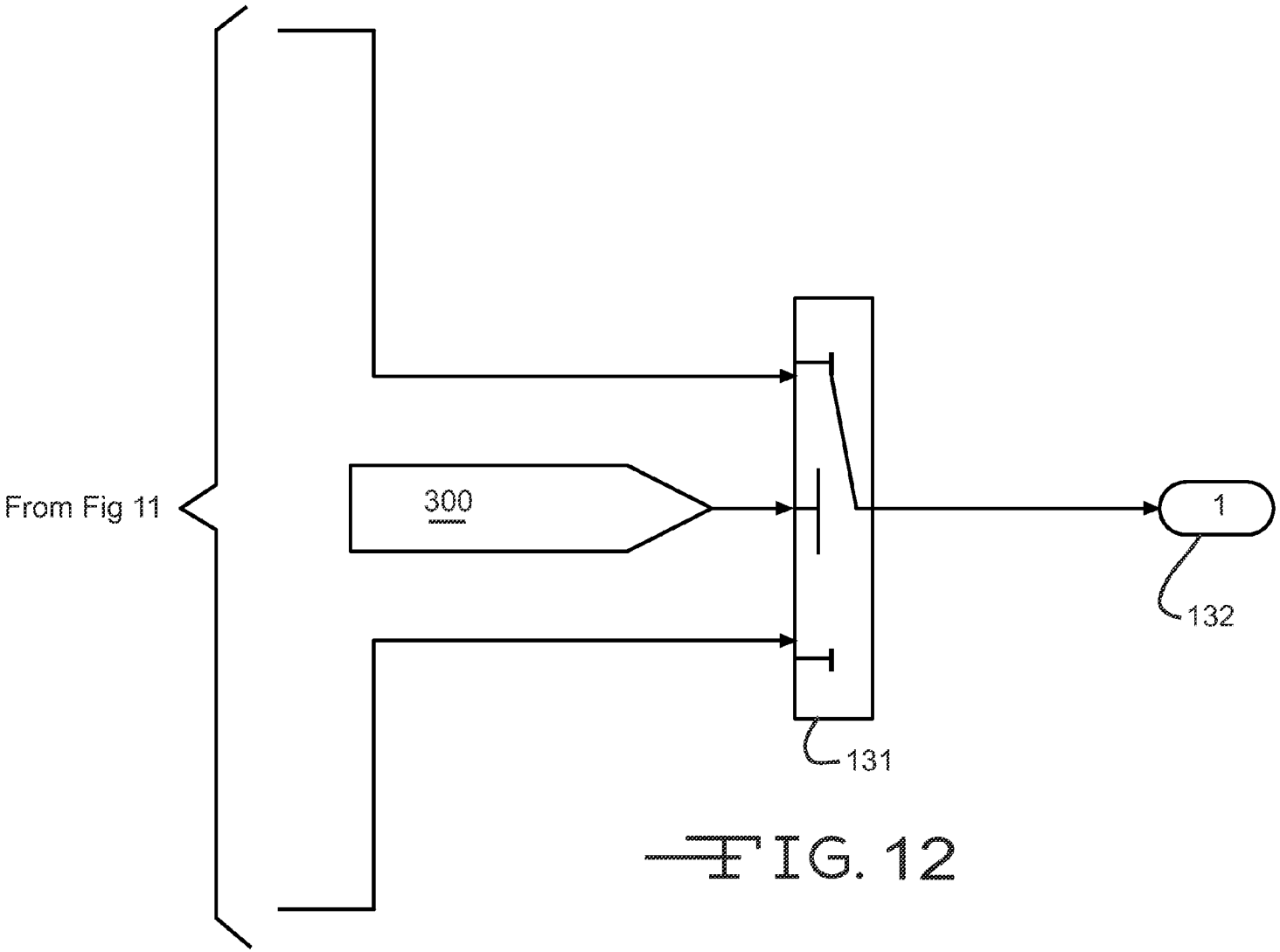
Figure 13:
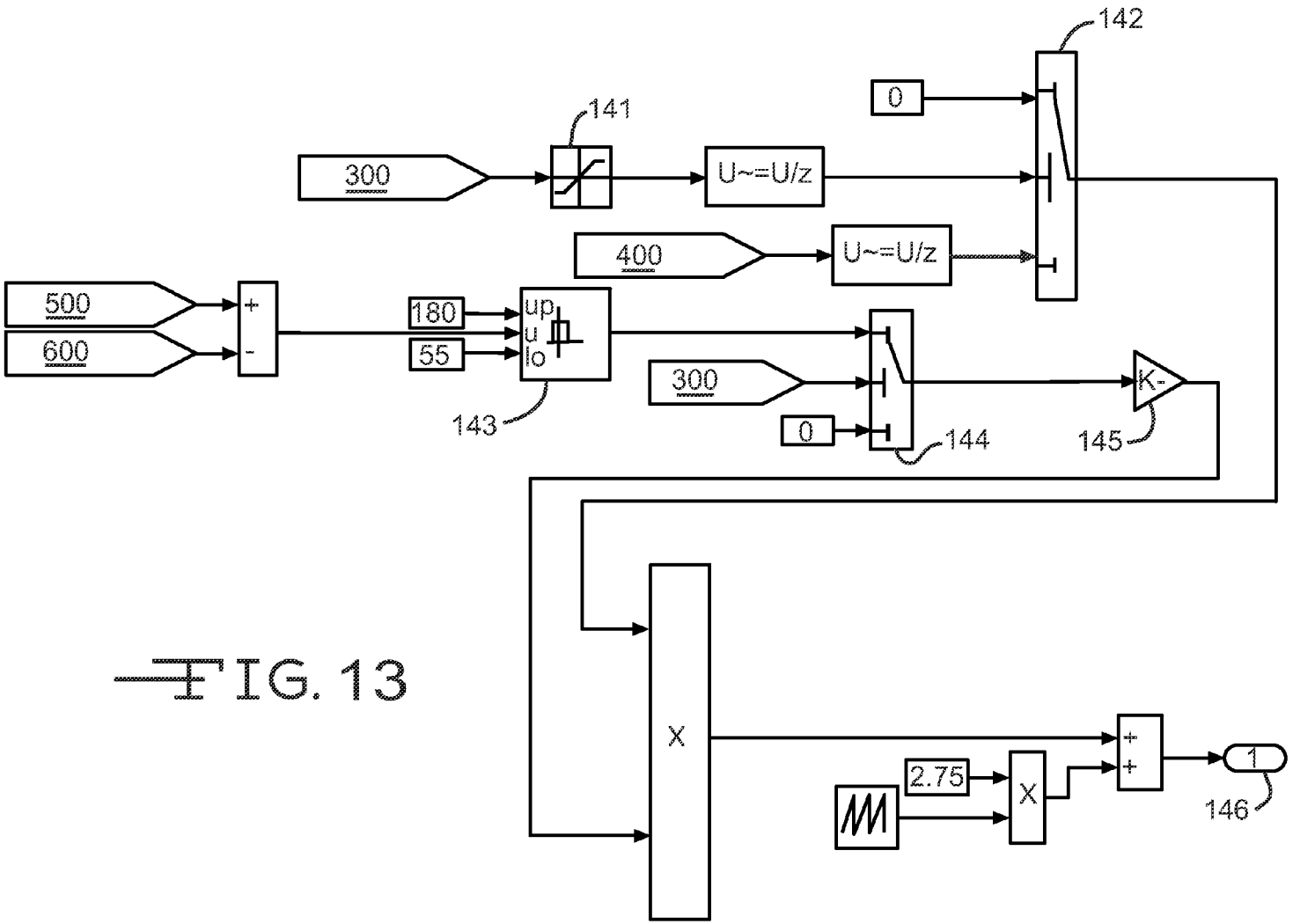
FIG. 13 is a schematic illustration of the operation of the hybrid management system of this disclosure.

FIGS. 10-12 combine to show the strategy that is used to initially predict system losses. When the swing torque command 110 is input, it is scaled to a percentage of maximum torque available at a specific motor speed 112. This conversion to a torque percentage is performed since it makes data lookup in the efficiency tables easier. Therefore, Block 113 contains the speed vs. maximum torque map for the swing motor in order to accomplish the conversion to torque percentage.

Further, Blocks 114 and 115 contain lookup tables that use torque percentage and the current motor speed 111 in order to look up motor and inverter efficiencies. For the purposes of the program, the inverter and motor should be efficiency mapped for both motoring and generating within the anticipated speed range in order to establish baseline data for use in this predictor algorithm.

FIG. 11 depicts how the efficiency data is delivered to two different calculations that determine efficiency for either motoring or regeneration. The two different calculation methods are needed because the additional electrical power required is calculated in order to produce the required motor output shaft torque when motoring; or the losses from the conversion of mechanical shaft torque to electrical energy is predicted for regenerating efforts. Once the additional torque or torque loss is calculated, taking into account swing torque commands 120 and 121, the value is summed with the command and then converted to a power by multiplying by motor speeds 122 and 123.

Referring to FIG. 12, the final section of the model shows that the sine of the motor torque 300 determines the final value that is calculated by this algorithm. A switch 131 then is operated according to the following: a positive value indicates motoring (providing swing propulsion) mode, while a negative value indicates regenerating mode, both of which are given as generator power 132.

While the model calculates loss for both motoring and regenerating cases, only the motoring case has use for controls work. The regeneration calculation is used in the model to predict efficiencies, track losses, and predict SOC for the component development and strategy work that is done.

The next step includes predicting changes in regenerative energy due to inertia changes in the swing system and the swing distance traveled. See FIG. 14. The first part of the algorithm involves a simplistic method for determining a change in the system inertia, taking into account motor torque 300 and the relative saturation at 141.

Importantly, the value of the acceleration rate 400 of the system should not change at a constant torque, unless there is a change in system inertia. Therefore, the value of the motor torque 300 is checked to see if a different value has been commanded; if the value of the motor torque 300 commanded has changed, then a '0' value is output from switch 142.

Another aspect of the algorithm checks to see if the upper structure (US) has swung more than about 50 degrees, such as more than about 55 degrees, since the start of motion, by taking into account swing position 500 and swing travel 600 through interval test dynamic calculation 143. If the US has swung more than this amount, the interval test has been passed and the degree value is sent to a switch 144 that checks to see if the machine is motoring based on motor torque 300. This is important because energy split or trimming energy functions only occur when motoring.

Once a gain constant 145 is applied to the swing travel calculation, both of these values are multiplied together. The result is a gain term that is calculated based upon US inertia change and degrees of powered (motoring) swing. This value is then added to a constant gain in order to determine a total inertia gain 146, which helps determine an initial power split.

Figure 14:
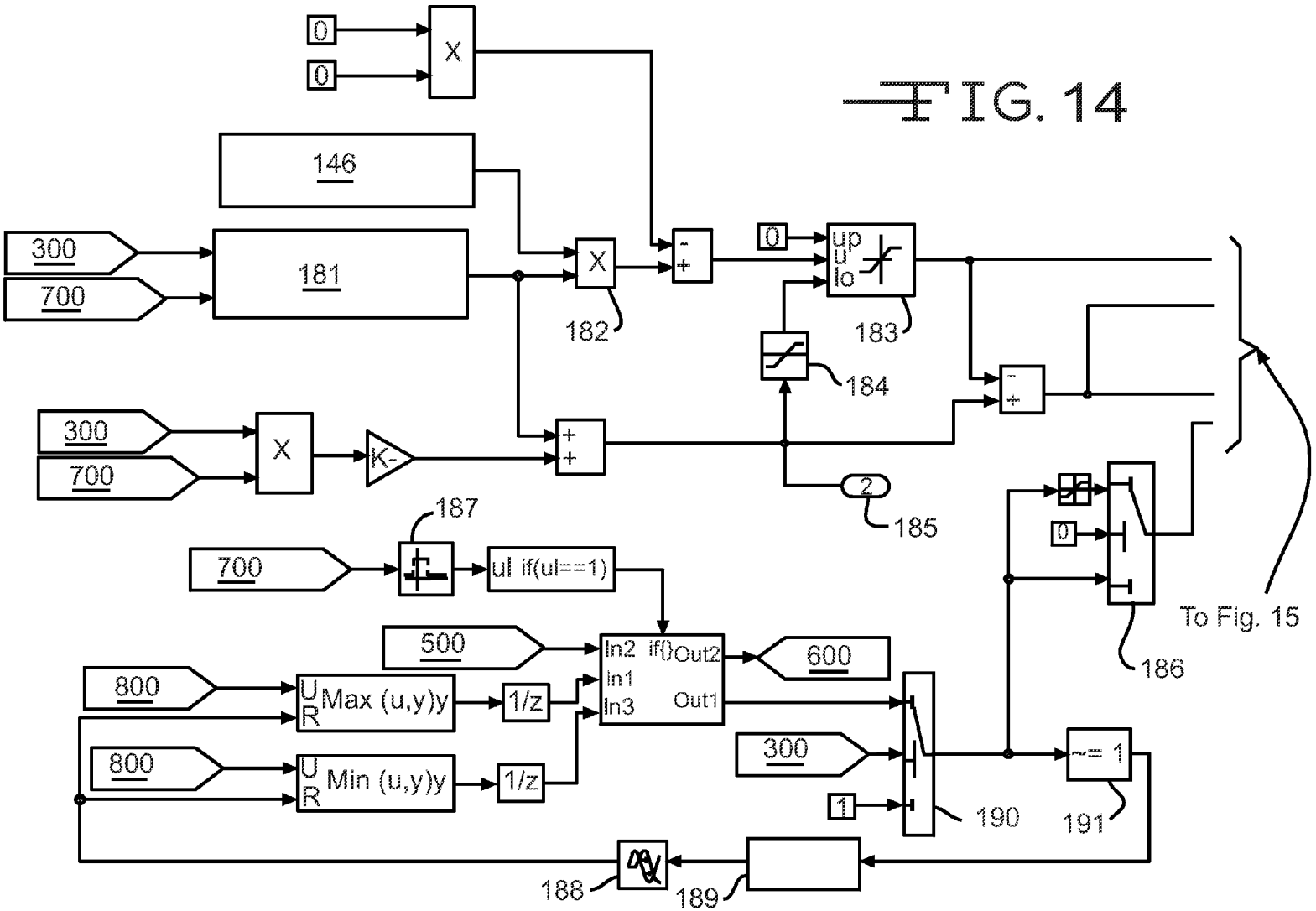
FIGS. 14-15 combine to form an overall schematic illustrating the operation of the hybrid management system of this disclosure.
Figure 15:
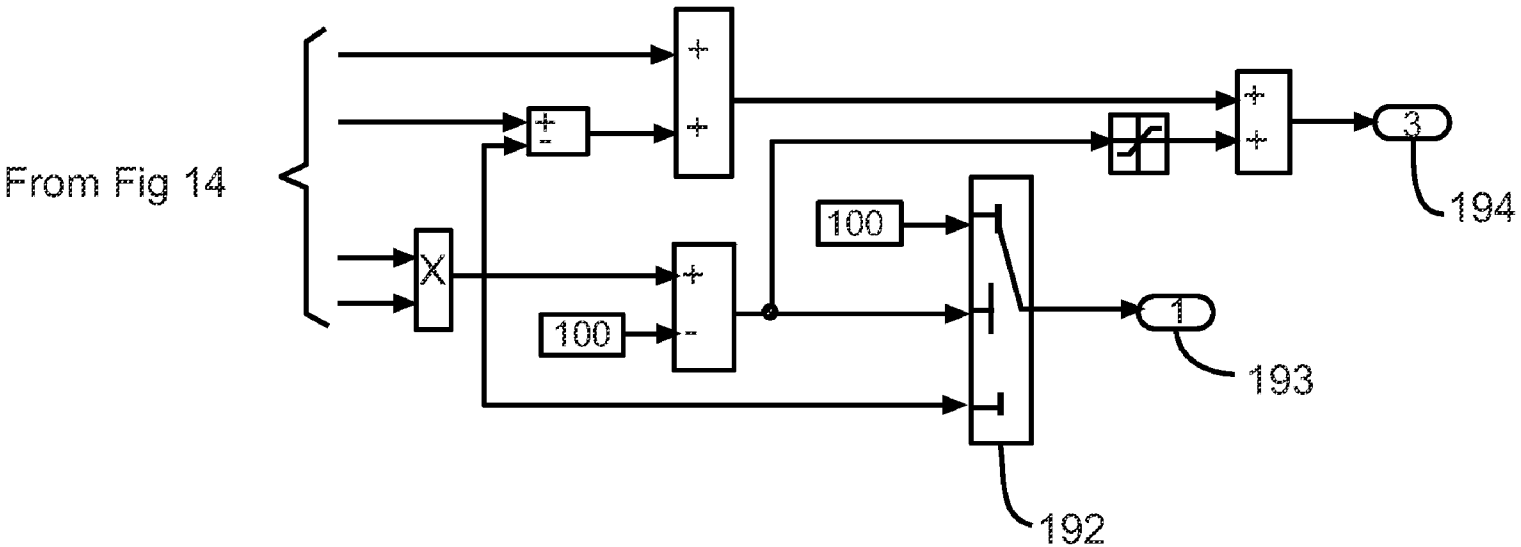
Figure 16:
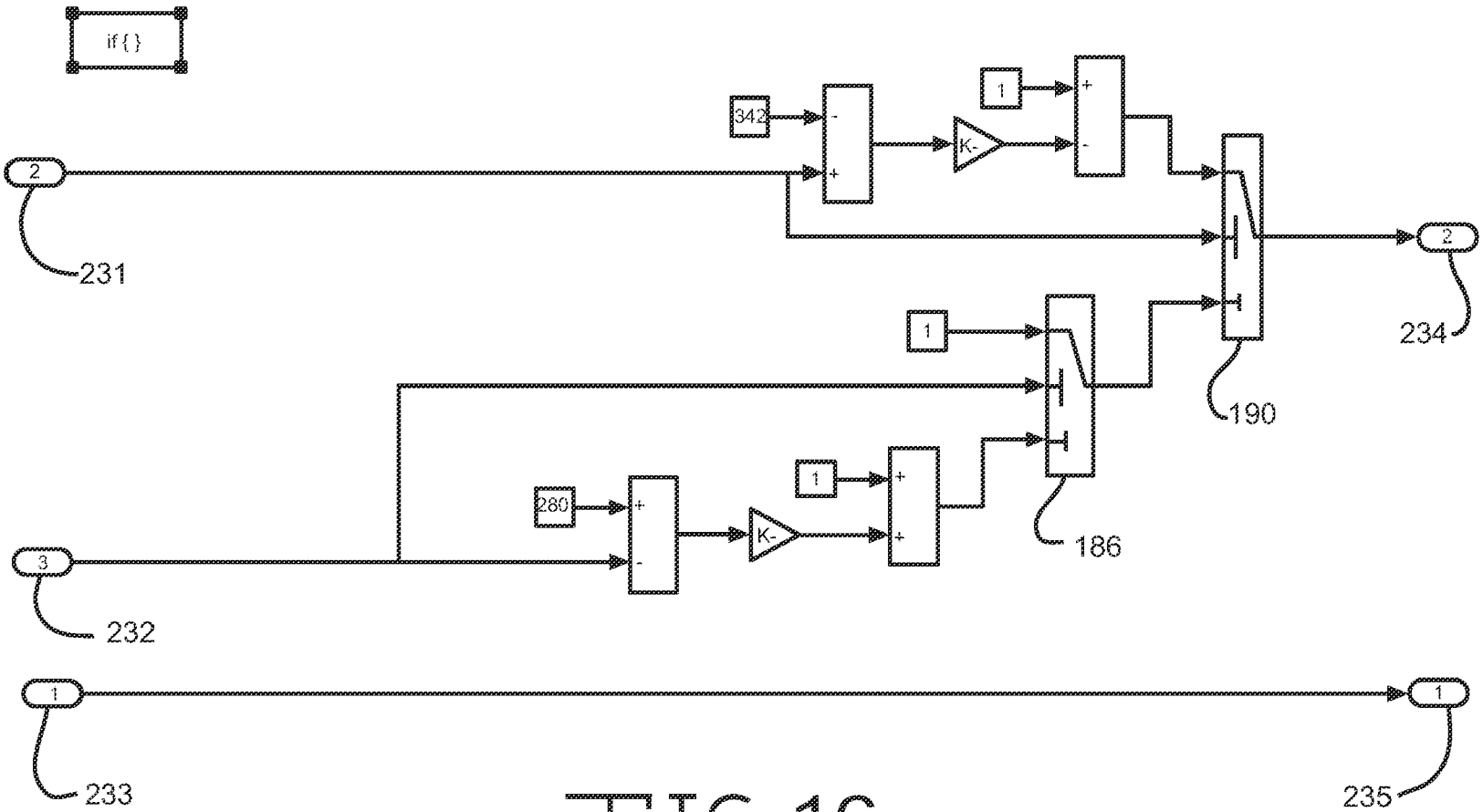
FIG. 16 is a schematic illustration of the operation of the hybrid management system of this disclosure.
Figure 17:
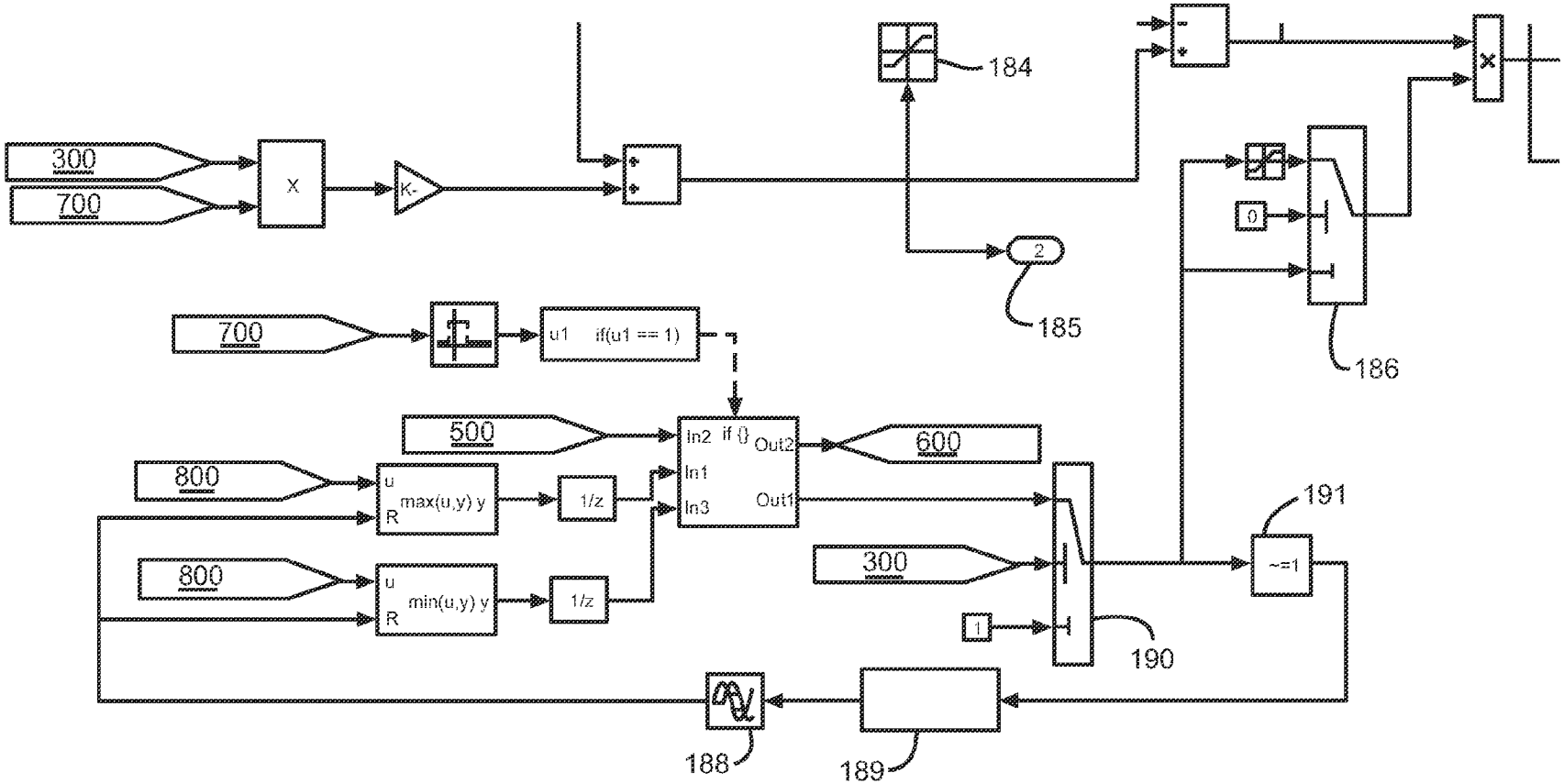
FIG. 17 is a schematic illustration of a portion of FIG. 14, detailing the trim function operation of the hybrid management system of this disclosure.

Referring to FIGS. 14, 15 and 17 (which is a detailed view of part of FIG. 14), the total inertia gain 146 represents a predicted loss term and a gain term that is multiplied at 182 by the predicted loss 181, which is determined in part from the motor torque 300 and raw motor speed 700. This becomes the swing energy that is provided by the generator to make up for system losses that are predicted to occur. The product of 182 then feeds an addition/subtraction block that removes the "transient torque assist" command from the generator command. The transient torque assist (TTA) command is subtracted from the predicted losses because the generator supplies the predicted losses. Therefore, reducing the energy to be drawn from the engine-mounted motor/generator 11 increases the amount of torque on the shaft. Since energy is being split between the motor/generator 11 and ESS 15, additional energy will be drawn from ESS 15 to make up for the energy that has been diverted to the transient torque assist.

The predicted loss 181 also is used to come up with an initial estimate for the electrical energy that will be required by the swing system to supply the required mechanical shaft torque at the swing motor output shaft.

At this point in the model, the saturation features 183 and 184 make sure that the generator does not produce more energy than requited by the swing command. In addition, this enforces a lag in pulling energy from the ESS so that operations such as, e.g., wall scrapping, do not pull energy from the ESS when there is no expectation of energy recovery. A portion of this power is shown as generator power 194.

After the initial energy command from ESS 15 is calculated, the value is trimmed in order to remain within the desired ESS range, and then is subject to a maximum energy check.

Switch 186 is where the trim value is introduced to the system. This is a switched input, because if a TTA command is active, i.e., a positive value, then the ESS command is not intentionally trimmed to a lower value, since that would mean pulling more energy from the generator. It is important to remember that—when the motor is supplying swing power—the TTA command functions by reducing the energy demanded from the generator. Saturation block 183 is present to limit the range between 1 and 2, which indicates energy drawn from ESS 15 as zero or some increased value.

The multiply block input from Switch 186 applies the trim value, and the summing block that is input from the multiply block adds or subtracts energy from the generator command in order to maintain the total output energy at the commanded value.

The multiply block from Switch 186 also provides input to a summing block that checks to insure that the ESS command is below the maximum ESS energy. The "constant 100" block is where the max energy command may enter the calculation, and if the ESS energy commanded is greater than the max energy allowed, the ESS energy command is reduced to the max ESS energy at Switch 192. Any energy that is above max energy is not added back to the generator command, because that would affect the TTA command and could cause engine 12 to perform poorly, e.g., stumble. This could cause subpar swing performance. The output of Switch 192 is then considered as the power for ESS 15.

Moreover, the hybrid energy management system may be used to keep the ESS SOC within desired maximum and minimum values by using the ESS trim value. The ESS SOC is allowed to vary within a range set via calibration parameters. The maximum recharge voltage and the minimum discharge voltage, which may be the actual calibration parameters, are used to set the maximum and minimum values. The minimum value should be at least about 195 VDC and the maximum value should be a less than about 345 VDC. In addition, the maximum and minimum values should take into account the maximum and minimum energy stored, since TTA, engine cranking, or "hotel loads" may place demands upon ESS 15.

The Interval test 187 provides a trigger signal input to the conditional execution block. This block becomes active when swing motor speed is zero. The algorithm within the conditional execution block is shown in FIG. 23. There, Input2 231 is the maximum regeneration voltage, and Input3 232 is the minimum discharge voltage. Input1 233 captures the present swing position 500. The swing position data is used to define the zero position for the inertia gain routine. The conditional execution block is set up to hold the most recent value it provided as output, and therefore can capture and hold the time/position at which events occurred. The blocks that have constant values of 280 and 342 are the minimum and maximum limit voltages. If the minimum drops below about 280 or the maximum goes above about 342, switch blocks 186 and 190 trigger and the difference between the min or max and the actual value is multiplied by the gain term. The result of said operation is then output as the trim value 234. If the voltage is below the minimum, trim value 234 calculated is below 1.0, which causes the ESS to deliver less energy than the original calculation output. The calculation for the maximum side works in a similar manner, but results in values trim value 234 above 1.0, and the energy that comes from the pack is greater than originally output.

Trim value 234, also noted as Out1 in FIG. 17, from the conditional execution block interacts with Switch 190 such that only trim values are output when the swing motor is providing energy to the swing system. Therefore, a "no trim" value of 1 is output in regenerative situations. Comparison block 191 checks to see if a "trim event" is occurring and sends a "logical true" output through converter 189 and transport delay 188 to the reset ports of the minimum and maximum functions that feed Input2 231 and Input3 232.

The minimum and maximum functions continuously monitor the pack voltage 800 to determine the min and max dc voltage values that the algorithm uses to determine when to create a trim value that is not 1.0. The transport delay 188 is represented graphically as a line, which may feed the min and max function with a delay. For example, in FIG. 18, the transport delay is shown as about a 5 second delay so that the trim value has a chance to have the desired effect on the ESS SOC.

Regarding limiting the pulse power, one primary purpose of setting up the pulse energy limit is to prevent the U-cap pack from being over-charged or over-discharged when the working cycle is running. The max charge/discharge energy that can be provided provide in the next interval, which may be a millisecond or even just a few microseconds, should continually be reported to the supervising controller so that the appropriate voltage range of the U-cap pack can be maintained.

In order to calculate the pulse energy limit, the information about the U-cap pack, such as the open circuit voltage and the series resistance, should be estimated and input into the management system.

When the U-cap pack is discharged, the output current generally creates a voltage drop across the series resistance. The higher the discharge energy, the deeper the expected voltage dip. When the terminal voltage hits the lowest limit tolerable by the system, the discharge energy reaches its maximum value. The current at this point can be calculated by:

$$i_o=(OCV-V_{min})/R_{series} \tag{1}$$

and the max discharge energy will be $$P_{dis_max}=V_oI_o=V_{min}(OCV-V_{min})/R_{series} \tag{2}$$

Note that the voltage drop caused by the capacitor charge loss ($\Delta u=\Delta Q/C$) is not taken into account in light of the millisecond time duration and large capacitance value.

Depending on the OCV, there is a possibility that the U-cap output current exceeds the maximum current limit, $i_{dis_max}$, the bi-directional DC converter can handle when the terminal voltage drops to the minimum value allowed. In this case, the terminal voltage is:

$$V_o=OCV-i_{dis_max}R_{series} \tag{3}$$

and the output power can be formulated as:

$$P_{dis_max}=V_oI_o=(OCV-i_{dis_max}R_{series})\cdot i_{dis_max} \tag{4}$$

Figure 18:
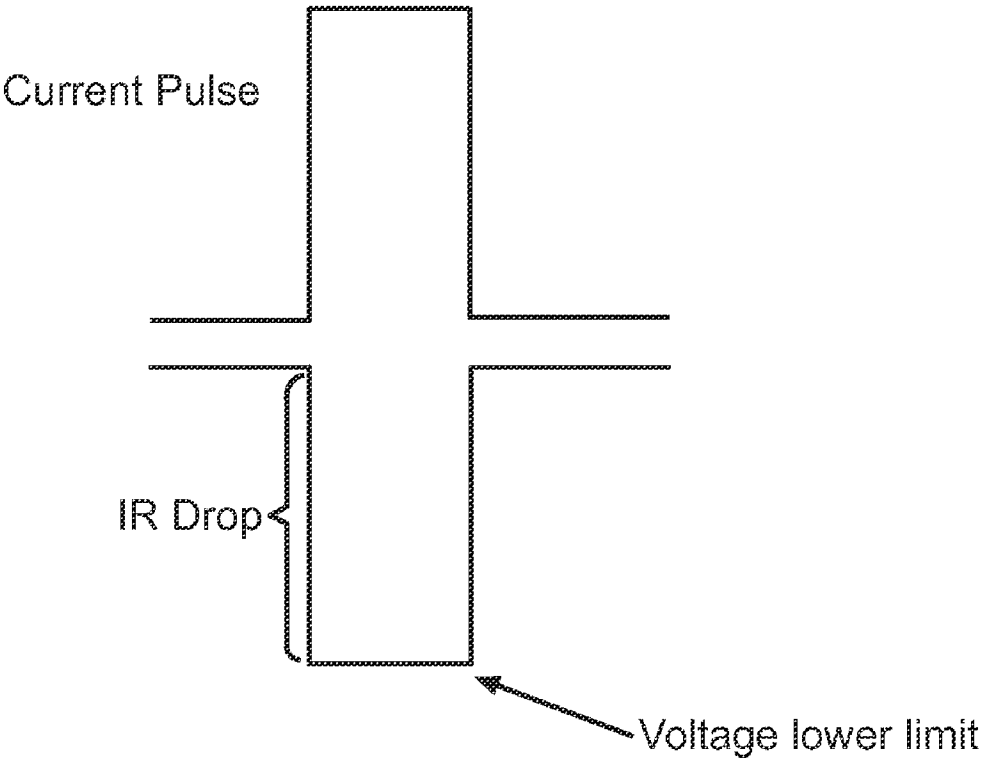
FIG. 18 is a schematic illustration of the voltage drop as it corresponds to a current pulse in the hybrid management system of this disclosure.

FIG. 18 shows U-cap voltage drop in discharging value.

From the above analysis, it can be seen that the maximum discharge power will be set by the minimum value of Equations (2) and (4). When $OCV-i_{dis_max}R_{series}<V_{min}$, Equation (2) will be the determining factor.

The same analysis can be applied to the calculation of charge power. The max charge power will be determined by the minimum value of the following equations:

$$P_{ch_max}=(V_{max}-OCV)/R_{series}\cdot V_{max} \tag{5}$$

$$P_{ch_max}=(OCV+i_{ch_max}R_{series})\cdot i_{ch_max} \tag{6}$$

When $OCV+i_{ch_max}R_{series}>V_{max}$, application of equation (5) will begin.

Figure 19:
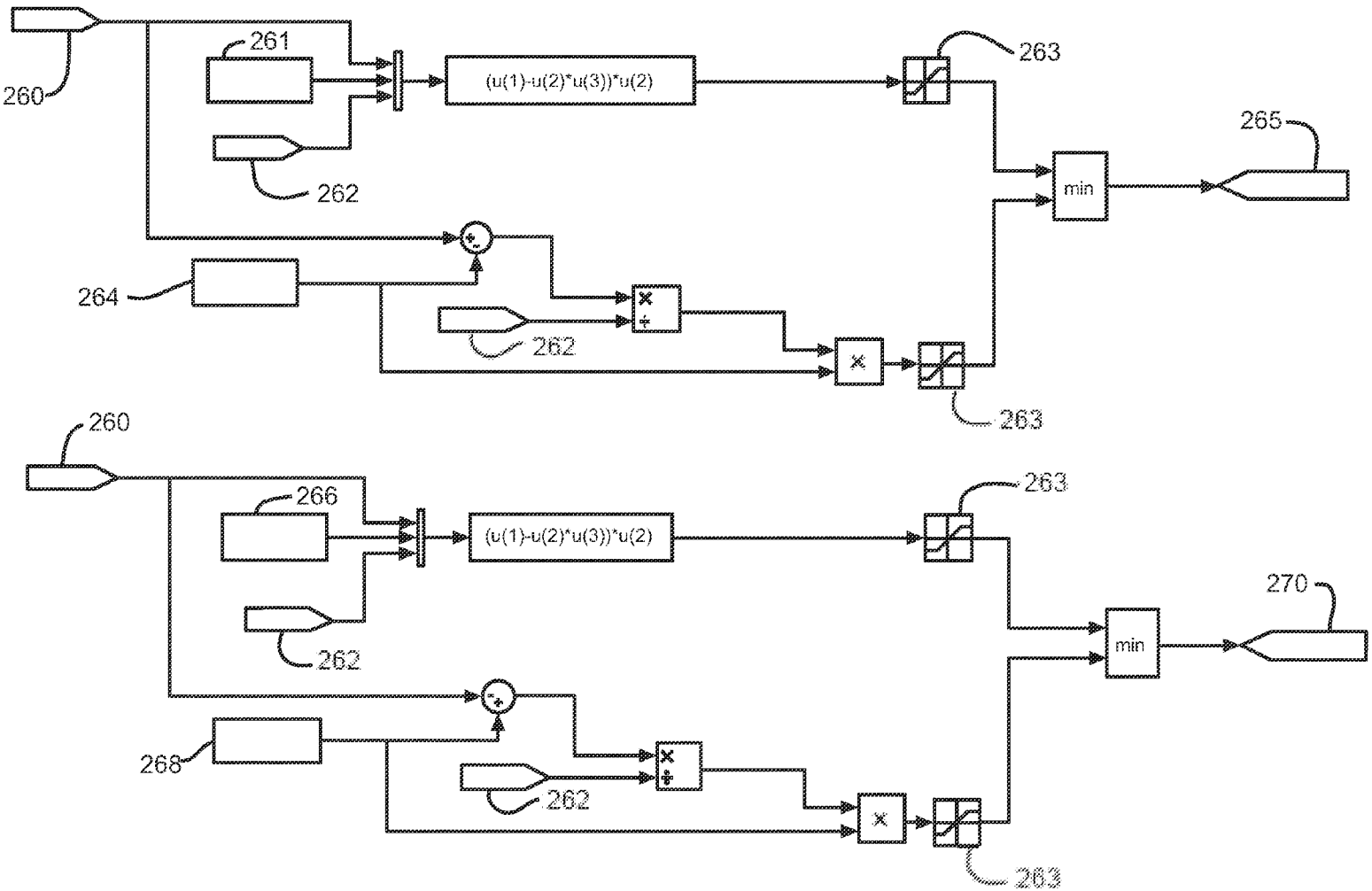
FIG. 19 is a schematic illustration of the operation of the hybrid management system of this disclosure.

FIG. 19 shows the model calculating the pulse energy limit. The saturation blocks 263 are used to keep the energy calculation positive. The open circuit voltage 260 is used in conjunction with the minimum voltage limit 264 or maximum voltage limit 268, depending on whether the discharge power limit 265 or charge power limit 270, respectively, is being calculated. To calculate discharge power limit 265, the maximum discharge current 261 and series resistance 262 is also utilized. To calculate charge power limit 270, the maximum charge current 266 and series resistance 262 is also utilized.

INDUSTRIAL APPLICABILITY

An embodiment of the present disclosure sets a maximum energy draw from the battery pack, using the generator to handle peak loading, is disclosed herein.

Any type of engine may be used in conjunction with this disclosure. Specific calibration may be appropriate to facilitate the application of machine energy management strategies disclosed herein to reduce the energy requirements of the engine for improved efficiency and fuel consumption.

Various configurations according to the present disclosure were analyzed to compare existing motor efficiencies with high efficiency motor designs. With higher efficiency motor designs, it is expected that up to about 8% to about 12% more energy could be recovered, bringing total recovery up to at least about 50%, such as at least about 60%, or even at least about 70%.

Future considerations include tying electro-hydraulic functions of the HEX (e.g., bucket, boom movement) to the battery management system.

Although the present inventions have been described with reference to exemplary embodiments, workers skilled in the art will recognize that changes may be made in form and detail without departing from the spirit and scope of the invention. For example, although different exemplary embodiments may have been described as including one or more features providing one or more benefits, it is contemplated that the described features may be interchanged with one another or alternatively be combined with one another in the described exemplary embodiments or in other alternative embodiments. Because the technology of the present invention is relatively complex, not all changes in the technology are foreseeable. The present invention described with reference to the exemplary embodiments and set forth in the flowing claims is manifestly intended to be as broad as possible. For example, unless specifically otherwise noted, the claims reciting a single particular element also encompass a plurality of such particular elements.

What is claimed is:

1. A machine having a body, a chassis, and an engine comprising:

a swing mechanism that rotates the body relative to the chassis about an axis;

an electric motor/generator in electrical communication with the swing mechanism;

an energy storage device in electrical communication with the swing mechanism; and an energy management system configured to determine a transition from a discharge period to a recovery period and responsively:

estimate the net energy generated by the swing mechanism during the recovery period;

limit the energy available for use from the energy storage device during the discharge period to the estimated net energy generated from the swing mechanism; and recharge the battery from the actual net energy generated during the recovery period.

2. The machine of claim 1, wherein the transition from a discharge period to a recovery period is correlated to the position of the body relative to the chassis.

3. The machine of claim 1 wherein the energy storage device is a battery.

4. The machine of claim 1 wherein the electric motor/generator operates in both a generating mode wherein energy is supplied to a swing motor and a motoring mode wherein engine transient assist is provided.

5. The machine of claim 4 wherein the engine transient assist is provided for between about 1 to about 2 seconds.

6. The machine of claim 1 further including one three-phase power inverter using IGBT technology.

7. The machine of claim 6 wherein the three-phase power inverter is rated from about 450 VAC to about 500 VAC.

8. The machine of claim 1 wherein the energy storage device is maintained as a substantially constant state of charge.

9. The machine of claim 1 further including a DC bus from about 600 VDC to about 700 VDC.

10. The machine of claim 1 wherein the swing mechanism includes a swing motor.

11. The machine of claim 10 wherein the swing motor is able to act as a motor/generator and recover at least about 40% of the swing energy.

12. The machine of claim 10 wherein the swing motor is at least about 85% efficient.

13. The machine of claim 1 wherein the electric motor/generator is at least about 90% efficient.

14. The machine of claim 1 wherein the energy storage device is at least about 85% efficient.

* * * * *